US005983455A

United States Patent [19]

Polzin et al.

[11] Patent Number: 5,983,455

[45] Date of Patent: Nov. 16, 1999

[54] MULTI-FACETED EXTENSION POLE

[75] Inventors: Bruce C. Polzin, Greendale; Anthony W. Gilbert, New Berlin; Robert A. Shaffer, Kenosha; Terrance M. Case, Milwaukee, all of Wis.

[73] Assignee: Newell Operating Company, Rockford, Ill.

[21] Appl. No.: 08/879,028

[22] Filed: Jun. 19, 1997

[51] Int. Cl.[6] ..... B25G 1/04

[52] U.S. Cl. ..... 16/429; 15/144.4

[58] Field of Search ..... 16/115; 81/177.2; 15/144.4; 403/109.1, 109.3, 109.5, 374.3, 377, 378; 473/549, 552, 298

[56] References Cited

U.S. PATENT DOCUMENTS

| | | | |
|---|---|---|---|
| 2,280,382 | 4/1942 | Davis | 473/549 |
| 4,524,484 | 6/1985 | Graham | 15/144.4 |
| 4,653,142 | 3/1987 | Upton | 16/115 |
| 4,794,663 | 1/1989 | Vosbikian | 15/144.4 |
| 4,922,577 | 5/1990 | Unger | 16/115 |
| 5,034,082 | 7/1991 | Nolan | 473/549 |
| 5,037,235 | 8/1991 | Aquilina | 16/115 |
| 5,220,707 | 6/1993 | Newman et al. | 15/144.4 |
| 5,464,210 | 11/1995 | Davis et al. | 473/549 |
| 5,515,574 | 5/1996 | Larson | 16/115 |
| 5,625,923 | 5/1997 | Huang | 16/115 |
| 5,729,865 | 3/1998 | Stoddart | 16/115 |

FOREIGN PATENT DOCUMENTS

| | | | |
|---|---|---|---|
| 2448877 | 4/1976 | Germany | 16/115 |
| 3046286 | 7/1982 | Germany | 16/115 |

*Primary Examiner*—Chuck Y. Mah
*Assistant Examiner*—Donald M. Gurley
*Attorney, Agent, or Firm*—Foley & Lardner

[57] ABSTRACT

A pole for supporting a tool includes an elongate body extending along an axis. The elongate body defines a plurality of outwardly facing facets about the axis. The elongate body preferably includes a first tube and a second tube telescopically received within the first tube for adjusting a length of the pole. The two tubes are locked relative to one another by a locking mechanism that is fixedly coupled to the first tube with a detent engaging member that extends from the locking mechanism into engagement with a detent defined by the first tube. The locking mechanism preferably comprises a collet which is threadably coupled to a chuck that defines a plurality of outwardly facing facets. Rotation of the chuck causes the chuck to overlap the detent engaging member and to frictionally clamp the collet against the second tube.

13 Claims, 4 Drawing Sheets

MULTI-FACETED EXTENSION POLE

FIELD OF THE INVENTION

The present invention relates to poles for supporting tools, such as paint applicators. In particular, the present invention relates to a pole having an improved surface configuration for enabling a user to better grip or adjust the length of the pole.

BACKGROUND OF THE INVENTION

Poles are commonly used for supporting a variety of tools to access otherwise unaccessible or unreachable areas. For example, poles are frequently used to support rollers in the application of paint, stains, varnishes or other coatings to ceilings and unreachable surfaces. Poles are also used to support a variety of other tools in the performance of other tasks such as dusting, tree pruning and the like.

Conventional tool supporting poles have a generally round cross-section. Alternatively, where additional strength is required of the pole, the round poles are frequently fluted along their length. Because conventional poles are round or fluted, users frequently have a difficult time gripping the poles and maneuvering the tools located at the end of the poles. This difficulty is intensified when the pole has a large length which increases the moment arm that must be supported and maneuvered by the user.

Many poles today are adjustable in length to provide increased flexibility and maneuverability when work needs to be done on surfaces having various heights and distances. To achieve adjustability, the poles generally include a first tube and a second tube telescopically received within the first tube. Once the tubes are telescopically extended or retracted so as to provide the pole with the desired length, the tubes are locked to one another by various means, including twist locks and tab locks.

Twist locks generally consist of a collet having a housing adhesively mounted to the first tube and a round sleeve or chuck which threadably engages the housing to comprise or clamp the collet against the second tube. Pole length adjustment is achieved by twisting or turning the chuck in a first direction to unclamp the collet so as to permit the tubes to be telescopically adjusted relative to one another. Once the pole is at the desired length, the chuck is twisted in a second opposite direction to once again clamp the collet against the second tube. One of the main advantages associated with the conventional twist lock is its ability to lock the first tube relative to the second tube anywhere along the length of the second tube. At the same time, however, threading the chuck onto the collet often requires multiple turns and large torques. Consequently, adjusting the length of the pole is frequently tedious, time consuming and fatiguing.

Tab locks generally consist of a housing adhesively mounted to the first tube and a pin that is pivotally biased towards the second tube. The second tube includes a plurality of spaced holes along its axis for receiving the pin to lock the first tube relative to the second tube. Pole length adjustment is achieved by activating a button, lever or the pin directly to withdraw the pin from one of the holes to enable the tubes to be telescopically adjusted relative to one another. At the desired length, the pin is inserted into a second one of the holes to secure the tubes relative to one another. Although easier to adjust than poles having a twist lock, poles having a tab lock have limited adjustability because the various lengths of the pole are strictly limited to the locations of the holes along the axis of the second tube. In addition, unintended rotation of the second tube relative to the first tube will misalign the pin and the holes to make length adjustment more difficult.

Although both the conventional twist lock and the conventional tab lock effectively lock the tubes relative to one another at a desired length, both the twist lock and the tab lock lack the durability required for many applications. Because the housing of both the twist lock and the tab lock is typically adhesively bonded to the first pole, the housing frequently becomes detached from the first tube upon impact or upon the pole undergoing severe expansion and contraction in response to temperature changes. Detachment of the twist lock or tab lock housing from the first tube renders the locking mechanism, and many times the pole itself useless.

As a result, there is a continuing need for a durable, light weight, tool supporting pole that is easy to grip and maneuver. There is a also a continuing need for an extendable pole that is durable and easy to adjust.

SUMMARY OF THE INVENTION

An improved pole for supporting a tool includes an elongate body extending along an axis. The body defines a plurality of outwardly facing facets about the axis. Preferably, the elongate body defines greater than four and less than sixteen outwardly facing facets. Preferably, the body defines greater than six and less than eleven outwardly facing facets. In the most preferred embodiment, the elongate body defines eight outwardly facing facets so as to provide at least a portion of the elongate body with an octagonal cross-sectional shape.

The invention is more specifically directed to the feature of the elongate body including first and second tubes, wherein the second tube is telescopically received within the first tube for adjusting a length of the pole. Either or both of the first and second tubes define the plurality of outwardly facing facets. In the preferred embodiment, the first tube further defines a plurality of inwardly facing facets about the axis corresponding to a plurality of outwardly facing facets defined by the second tube.

According to one preferred aspect of the present invention, the plurality of outwardly facing facets are defined at least along a handle portion of the elongate body. Preferably, the plurality of outwardly facing facets extend substantially along an entire length of the elongate body.

The invention is further directed to a locking mechanism for selectively locking the second tube relative to the first tube along the axis. The locking mechanism is preferably fixedly coupled to the first tube by a connector including a detent engaging member extending from the locking mechanism into engagement with a corresponding detent defined in the first tube. In the most preferred embodiment, the locking mechanism comprises a collet and a corresponding chuck for clamping the collet about the second tube. The chuck overlaps the detent engaging member to maintain the detent engaging member in engagement with the detent.

The invention is further directed to an extendable pole having first and second tubes telescopically adjustable relative to one another. The pole includes a locking mechanism for locking tubes relative to one another. The locking mechanism includes a collet and a chuck which threadably engages the collet to clamp the collet about one of the tubes. The chuck defines a plurality of outwardly facing facets. In the preferred embodiment, the chuck defines greater than four and less than sixteen outwardly facing facets. Preferably, the chuck defines greater than six and less than eleven outwardly facing facets. In the most preferred embodiment, the chuck defines eight outwardly facing facets.

DETAILED DESCRIPTION OF THE PREFERRED EMBODIMENTS

Figure 1:
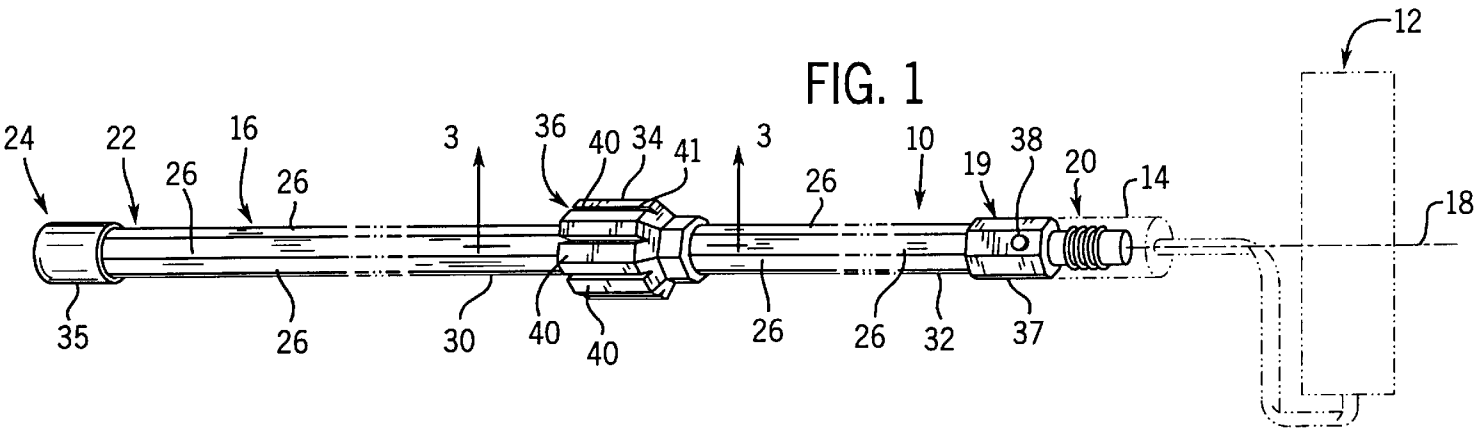
FIG. 1 is a perspective view illustrating a pole of the present invention supporting a tool.

FIG. 1 is a perspective view illustrating pole 10 supporting a tool 12 (shown in phantom). In the preferred embodiment illustrated, tool 12 comprises a paint applicator. More specifically, tool 12 preferably comprises a conventionally known paint roller attachment having an end portion 14 specifically configured for being coupled to pole 10. Tool 12 is used for applying paint, stains, varnishes or other coatings to ceilings or otherwise unreachable surfaces. As can be appreciated, tool 12 may alternatively comprise any one of a variety of well known tools which must be supported by pole 10 to access otherwise unaccessible or unreachable areas.

Pole 10 is a generally elongate body 16 extending along axis 18. Body 16 includes a tool supporting portion 19 at a first end 20 and a handle portion 22 proximate a second opposite end 24. Tool supporting portion 19 is specially configured for coupling with tool 12. At the same time, handle portion 22 is located at end 24 to enable a user to grasp pole 10 so that tool 12 may be positioned and maneuvered for accessing otherwise unaccessible or unreachable areas. To enable the user to better grip pole 10 and to better maneuver tool 12, body 16 defines a plurality of outwardly facing facets 26 in handle portion 22. In the preferred embodiment illustrated, body 16 defines a plurality of outwardly facing facets 26 substantially along its entire length from first end 20 to second end 24.

Figure 4:
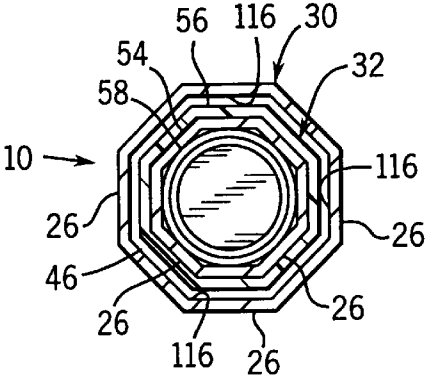
FIG. 4 is a cross-sectional view of the pole taken along lines 4—4 of FIG. 3.

Outwardly facing facets 26 are generally flat, planar surfaces which contiguously extend about axis 18. Preferably, body 16 defines less than sixteen and greater than four outwardly facing facets contiguously extending about axis 18. It has been discovered that if body 16 defines sixteen or more facets, the grip provided by facets 26 is less secure such that handle portion 22 of pole 10 is more likely to twist or turn in the user's hands during positioning and maneuvering of pole 10. At the same time, it has been discovered that if body 16 defines four or less contiguous outwardly facing facets about axis 18, handle portion 22 is difficult to grip because of the sharp edges or corners formed where adjacent facets meet. These sharp edges cut into the user's hands and make positioning and maneuvering of pole 10 difficult. More preferably, body 16 includes less than eleven and greater than six outwardly facing facets. As best shown by FIG. 4, body 16 of the most preferred embodiment defines eight contiguous outwardly facing facets about axis 18 such that body 16 has a generally octagonal cross-section. In addition to being visually appealing, eight outwardly facing contiguous facets have been discovered to best conform to the bends and joints of a user's hands. Accordingly, body 16 defines eight outwardly facing contiguous facets 26 about axis 18 to provide the user with the most stable, as well as the most comfortable grip. Because body 16 includes eight outwardly facing facets, body 16 provides the user with an ergonomic and less fatiguing grip that is less susceptible to slippage even when wet from paint or perspiration. Because body 16 preferably defines outwardly facing facets about axis 18 along substantially the entire length of pole 10, pole 10 enables the user to effectively grasp pole 10 anywhere along the length of pole 10 as necessary. As a result, less effort is required to position and hold up pole 10.

In the preferred embodiment illustrated by FIG. 1, pole 10 comprises an extendable pole generally including outer pole 30, inner pole 32 and locking mechanism 34. Outer pole 30 is a generally elongate hollow tube defining facets 26 and forming handle portion 22 of pole 10. In the preferred embodiment illustrated, outer end 24 of outer pole 30 is capped by end cap 35. Outer pole 30 has a second opposite end 36 which supports locking mechanism 34 and which telescopically receives inner pole 32.

Inner pole 32 is an elongate tube extending through locking mechanism 34 and telescopically received within outer pole 30. Inner pole 32 defines facets 26 and tool supporting portion 19 of pole 10. As best shown by FIG. 1, inner pole 32 preferably has a pole tip 37 configured for threadably engaging mounting portion 14 of tool 12. Pole tip 36 is preferably fixedly coupled to inner pole 32 by a fastener, such as pop rivet 38 or an adhesive or other means.

Figure 5:
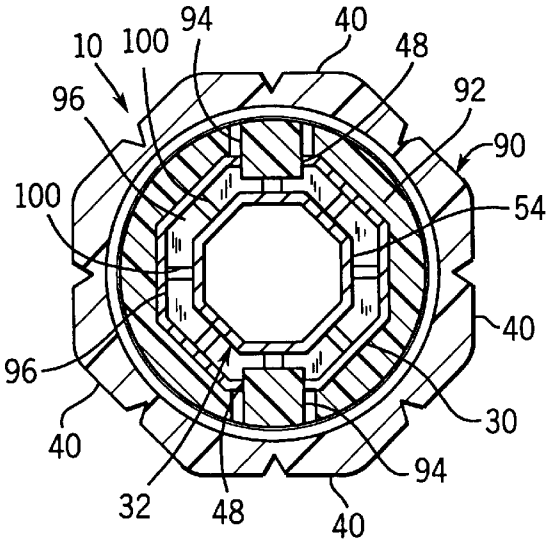
FIG. 5 is a cross-sectional view of the pole taken along lines 5—5 of FIG. 3.

Locking mechanism 34 selectively locks inner pole 32 relative to outer pole 30 along axis 18. As shown by FIG. 1, locking mechanism 34 preferably has an outer surface which defines a plurality of outwardly facing facets 40 contiguously extending about axis 18. Each facet 40 is a generally flat, planar surface contiguously extending about axis 18. Each facet 40 additionally includes a slot 41. Preferably, locking mechanism 34 has an outer surface which defines less than sixteen and greater than four outwardly facing facets about axis 18. Preferably, locking mechanism 34 defines greater than six and less than eleven outwardly facing facets. In the most preferred embodiment illustrated, as best shown by FIG. 5, locking mechanism 34 defines eight outwardly facing facets so as to provide locking mechanism 34 with a generally octagonal cross-sectional shape. Due to the plurality of outwardly facing facets about axis 18, locking mechanism 34 is more stably and more comfortably gripped by a user. As a result, pole 10 may be gripped about locking mechanism 34. In the preferred embodiment illustrated, locking mechanism 34 preferably includes a twist locking arrangement. Thus, the plurality of outwardly facing facets 40 permit easier, more ergonomic and less fatiguing gripping and rotation of locking mechanism 34 relative to poles 30 and 32 for quicker and easier locking and unlocking of poles 30 and 32 relative to one another.

Figure 2:
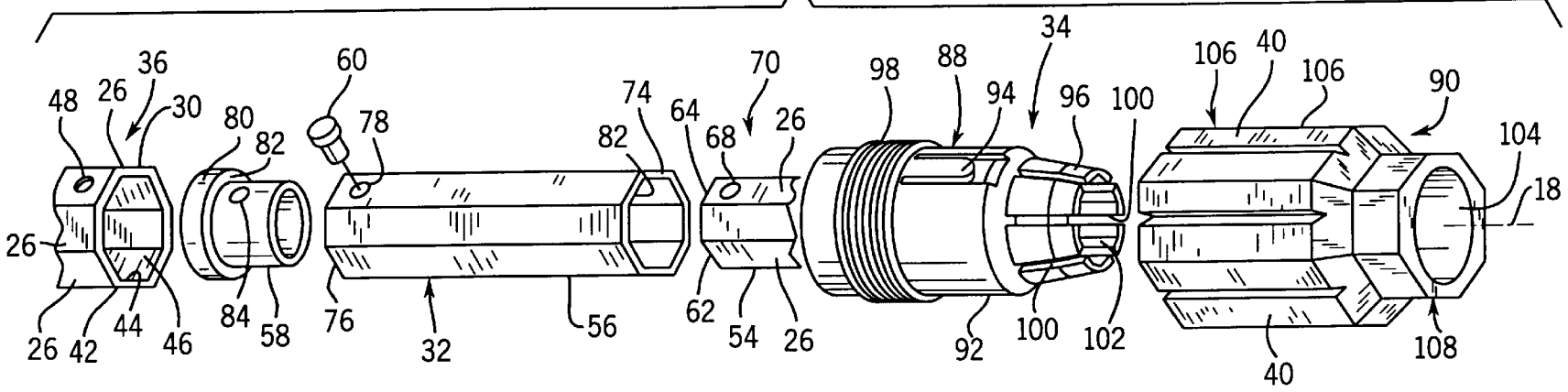
FIG. 2 is an exploded fragmentary perspective view of the pole of FIG. 1.

FIG. 2 is an exploded fragmentary perspective view illustrating portions of outer pole 30, inner pole 32 and locking mechanism 34 in greater detail. As best shown by FIG. 2, outer pole 30 includes a wall 42 which defines opening 44, hollow interior 46 and at least one detent 48. Opening 44 is located at end 36 of pole 30 and is sized for receiving inner pole 32. Hollow interior 46 is also sized for receiving inner pole 32.

In the preferred embodiment illustrated, wall 42 defines a pair of opposite detents 48 extending into opposite facets 26 at end 36 of pole 30. Detents 48 are generally holes or depressions that extend into one of facets 26 towards interior 46. Detents 48 preferably extend completely through wall 42. Detents 48 are sized for receiving corresponding protuberances of locking mechanism 34 to fixedly couple locking mechanism 34 to outer pole 30.

In the preferred embodiment illustrated, outer pole 30 has a nominal outer diameter between opposite facets 26 of about 1.179 inches and a nominal inner diameter of about 1.019 inches. Outer pole 30 is preferably formed from fiberglass. Alternatively, outer pole 30 may be formed from a variety of alternative materials, such as aluminum, with a variety of well known conventional alternative manufacturing processes.

Inner pole 32 is slidably and telescopically received within interior 46 of outer pole 30 and includes inner tube 54, sleeve stop 56, inner guide 58 and fastener 60. Inner tube 54 is an elongate, preferably hollow, shaft extending substantially along the entire length of inner pole 32. Similar to outer pole 30, inner tube 54 of inner pole 32 defines a plurality of outwardly facing facets 26. Inner tube 54 has an outer diameter less than the inner diameter of outer pole 30. As shown by FIG. 1, inner tube 54 supports pole tip 37 at a first end 20. As shown by FIG. 2, inner tube 54 includes a wall 62 which defines an axial opening 64, a hollow interior 66 (best shown in FIG. 3) and a side bore 68 at end 70. Axial opening 64 axially communicates with interior 66 of inner tube 54 and is sized for receiving inner guide 58. Side bore 68 extends through wall 62 and is sized for receiving fastener 60.

In the preferred embodiment illustrated, inner tube 54 has a nominal outer diameter between opposite facets 26 of about 0.912 inches. Pole 32 is preferably formed from extruded aluminum. As can be appreciated, pole 32 may alternatively be formed from a variety of alternative materials with a variety of well known conventional alternative manufacturing processes.

Sleeve stop 56 is a generally elongate hollow tube or sleeve sized for sliding over and about inner tube 54 and for sliding within interior 46 of outer pole 30.

Sleeve stop 56 defines axial faces 74, 76 and side bore 78. Axial faces 74 and 76 extend at opposite ends of sleeve stop 56. Axial face 74 is preferably dimensioned for engaging locking mechanism 34 to prevent inner pole 32 from becoming completely withdrawn from outer pole 30. Side bore 78 extends through sleeve stop 56 and is sized and located for being aligned with side opening 68 and for receiving fastener 60.

In the preferred embodiment illustrated, sleeve stop 56 has a nominal inner diameter of about 0.935 inches and a nominal outer diameter of about 0.995 inches. Sleeve stop 56 is preferably formed from polyvinyl chloride. Inner guide 58 fixedly mounts to end 70 of inner tube 54 and defines outer guide or bearing surface 80. In the preferred embodiment illustrated, inner guide 58 comprises a hollow tubular plug configured for being received within interior 66 of inner tube 54. To secure inner guide 58 to end 70 of inner tube 54, inner guide 58 additionally defines shoulder 82 and side bore 84. Shoulder 82 butts against end 70 of inner tube 54 while side bore 84 aligns with side bore 68 and 78 of inner tube 54 and sleeve stop 56 for receiving fastener 60. Guide surface 80 is dimensioned so as to extend about axis 18 beyond sleeve stop 56. Guide surface 80 is preferably dimensioned so as to slidably engage surfaces of interior 46 of outer pole 30 during deformation of outer tube 30 relative to inner tube 32. In the preferred embodiment illustrated, inner guide 58 is formed from polypropylene. As can be appreciated, inner guide 58 may form from a variety of alternative materials.

Fastener 60 is configured for extending through side bores 78, 84 and 68 of sleeve stop 56, inner guide 58 and inner tube 54, respectively. In the preferred embodiment illustrated, fastener 60 comprises a pop rivet. As can be appreciated, fastener 60 may comprise any one of a variety of alternative fasteners well known in the art. Moreover, in lieu of fastener 60, other means may be used for securing sleeve stop 56 and inner guide 58 to inner tube 54, such as adhesives, staking and the like.

Locking mechanism 34 generally includes collet 88 and sleeve or chuck 90. Collet 88 fixedly mounts to end 36 of outer pole 30 and includes a generally tubular body 92, detent engaging members 94 (best shown in FIGS. 3 and 5), clamping flanges 96 and exterior threads 98. Body 92 of collet 88 is a generally hollow tubular member. Body 92 preferably defines a plurality of inwardly facing facets 99 (shown in FIG. 3) facing outwardly facing facets 26 of outer pole 30. Inwardly facing facets 99 mirror facets 26 and extend sufficiently close to facets 26 to limit or prevent rotation of body 92 of collet 88 relative to outer pole 30. Body 92 receives end 36 of outer pole 30 to align detent engaging members 94 with detents 48.

Detent engaging members 94 are generally male protuberances supported by body 92 and configured for at least partially being received within female detents 48 so as to fixedly couple collet 88 to end 36 of outer pole 30. Alternatively, outer pole 30 may include a detent engaging member while body 92 defines a corresponding detent to fixedly couple collet 88 to end 36 of outer pole 30. Because inwardly facing facets 99 prevent or substantially limit rotation of collet 88 relative to outer pole 30, facets 99 simplify alignment of detent engaging members 94 with detents 48. In the preferred embodiment illustrated, detent engaging members 94 are resiliently biased towards axis 18 so as to automatically project into detents 48 once detent engaging members 94 are aligned with detents 48. Preferably, detent engaging members 94 are formed from a flexible, yet resilient material such as a polypropylene copolymer and are formed with body 92 so as to naturally project into detent 48. As a result, collet 88 may be simply snapped over onto outer pole 30 to mount collet 88 and locking mechanism 34 to outer pole 30. Thus, manufacture of collet 88 is simplified. Although more complex, detent engaging member 94 may alternatively be resiliently biased towards detent 48 by springs or other biasing mechanisms.

Clamping flanges 96 generally comprise elongate fingers projecting from body 92 for engagement with the exterior surface of inner tube 54. Clamping flanges 96 are preferably made from a flexible resilient material so that flanges 96 may be repeatedly clamped into and out of frictional engagement with inner tube 54. Flanges 96 extend about axis 18 and are separated by gaps or slits 100 to better enable flanges 96 to be clamped against inner tube 54. Flanges 96 are preferably integrally formed with body 92 from a flexible resilient material such as a polypropylene copolymer and are formed so as to naturally define an inner diameter 102 greater than the outer diameter of inner tube 54 for permitting inner tube 54 to slide between flanges 96 with minimal friction when chuck 90 is loosened. Exterior threads 98 extend about body 92 and are configured for threadably engaging corresponding interior threads within chuck 90.

Chuck 90 is a generally hollow tubular member defining an interior 104 and is generally tapered from end 106 towards end 108. Interior 104 further defines interior threads 110 (shown in FIG. 3) for threadably engaging exterior threads 98 of collet 88. Interior 104 opens at end 108 for permitting movement of inner tube 54 through chuck 90. Exterior surface 106 defines outwardly facing facets 40 for enabling chuck 90 to be more easily threaded upon collet 88 with greater torque and less slip such that tapered interior 104 compresses flanges 96 of collet 88 towards one another to reduce diameter 102 and to clamp flanges 96 against inner tube 54.

Figure 3:
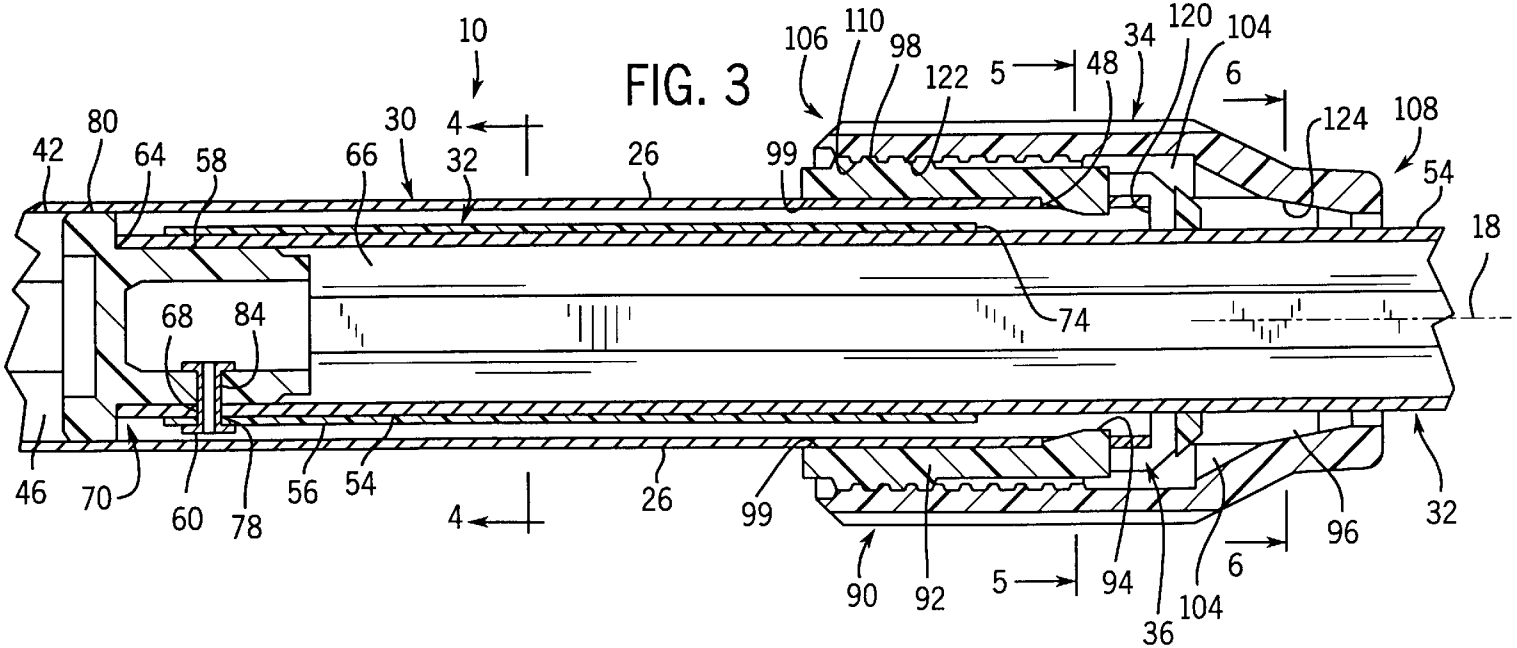
FIG. 3 is a sectional view of a portion of the assembled pole of FIG. 1.
Figure 1A:
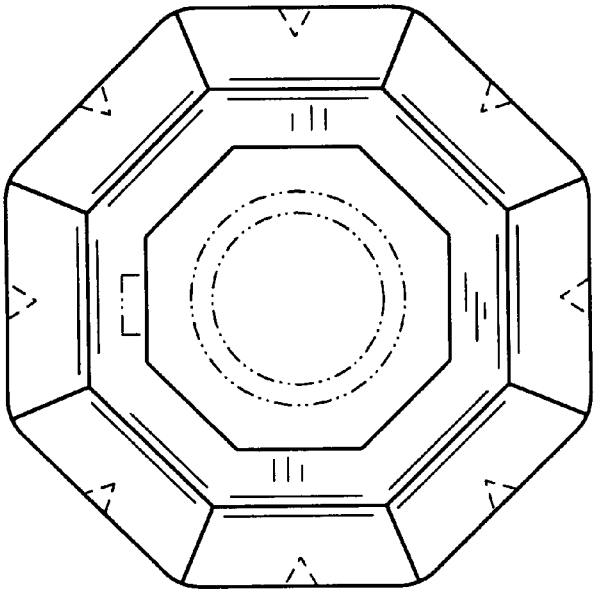
FIG. 1A is a right side elevational view of the pole of FIG. 1.
Figure 1B:
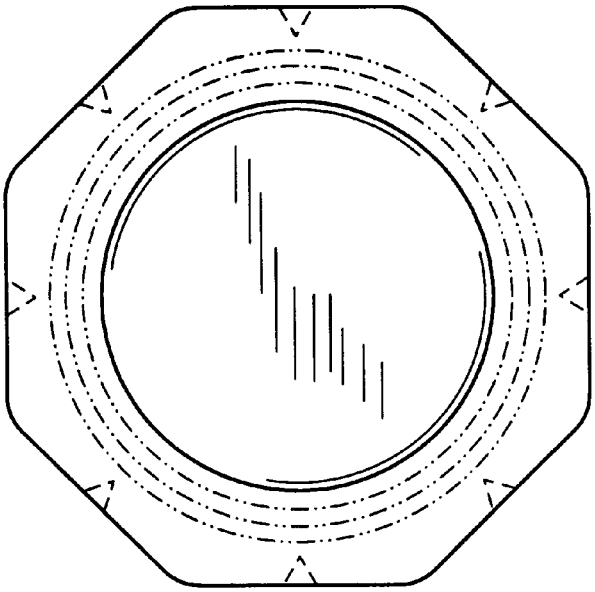
FIG. 1B is a left side elevational view of the pole of FIG. 1.
Figure 6:
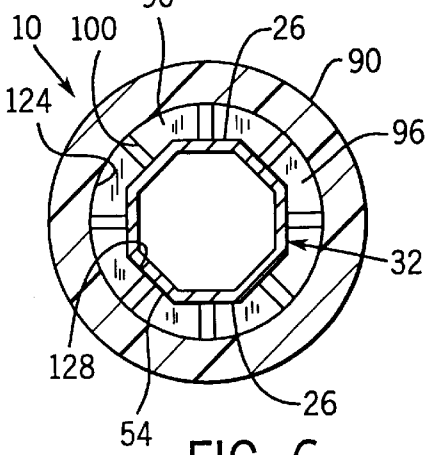
FIG. 6 is a cross-sectional view of the pole taken along lines 6—6 of FIG. 3.

FIGS. 3–6 illustrate assembled pole 10 in greater detail. FIG. 3 is a cross-sectional view of assembled pole 10 taken along lines 3—3 of FIG. 1. FIG. 4 is a cross-sectional view of pole 10 taken along lines 4—4 of FIG. 3. FIG. 5 is a cross-sectional view of pole 10 taken along lines 5—5 of FIG. 3. Similarly, FIG. 6 is a cross-sectional view of pole 10 taken along lines 6—6 of FIG. 3. FIGS. 3 and 4 illustrate inner pole 32 slidably and telescopically received within outer pole 30 to permit length adjustment of pole 10. As best shown by FIG. 3, inner tube 54 of inner pole 32 is received within outer pole 30 and extends past end 36 of outer pole 30 through locking mechanism 34. As inner tube 54 telescopically moves within outer pole 30, inner tube 54 carries sleeve stop 56 and inner guide 58. Sleeve stop 56 is slid about inner tube 54 adjacent end 70. Sleeve stop 56 preferably extends from proximate end 70 towards end 20 (shown in FIG. 1) and defines an axial face 74. Axial face 74 outwardly extends away from pole 32 for engaging collet 88 during extension of inner pole 32 relative to outer pole 30. Axial face 74 engages collet 88 to limit the extent to which inner pole 32 may be withdrawn from outer pole 30. In the preferred embodiment, axial face 74 is spaced greater than approximately four inches from end 70 of inner tube 54. As can be appreciated, sleeve stop 56 may have different lengths and may be secured to inner tube 54 at different locations while still defining axial face 74.

Inner guide 58 extends through opening 64 so as to align side bore 84 with correspondingly aligned bores 68 and 78 of inner tube 54 and sleeve stop 56, respectively. Bearing surface 80 defined by inner guide 58 engages wall 42 within interior 46 of outer pole 30 to center inner pole 32 within outer pole 30 during movement of inner pole 32 within outer pole 30. As a result, bearing surface 80 centers inner pole 32 within outer pole 30 to prevent inner pole 32 from binding with outer pole 30 and to enable easier length wise adjustment of pole 10. Fastener 60 extends through bores 78, 68 and 84 to fixedly couple sleeve stop 56 and guide 58 to inner tube 54. Alternatively, sleeve stop 56 and guide 58 may be staked or adhesively bonded to inner tube 54.

As best shown by FIG. 4, outer pole 30 defines a plurality of inwardly facing facets 116 about interior 46. Facets 116 preferably face corresponding opposite facets 26 defined by inner tube 54 and sleeve stop 56. Because inwardly facing facets 116 face outwardly facing facets 26 of inner pole 30, inwardly facing facets 116 limit or prevent rotation of inner pole 32 relative to outer pole 30. As a result, the torque exerted upon collet 88 of lock mechanism 34 is reduced.

FIGS. 3, 5 and 6 illustrate locking mechanism 34 actuated so as to clampingly secure inner pole 32 relative to outer pole 30 once pole 10 is adjusted to have a desired length. As shown by FIGS. 3 and 5, body 92 of collet 88 receives end 36 of outer pole 30 such that detent engaging members 94 become aligned with and project into detents 48 of outer pole 30 to fixedly couple body 92 to outer pole 30. As a result, detent engaging members 94 and detents 48 form a mechanical lock or hold that more reliably secures body 92 to outer pole 30. This mechanical hold is more reliable than conventional compression or glue holds which are subject to creep, slippage or failure under thermal expansion.

Body 92 additionally includes an inwardly extending lip 120 extending over end 36 of outer pole 30 into close proximity with inner tube 54 of inner pole 32. Lip 120 is preferably spaced from inner tube 54 so as to guide, but not inhibit movement of inner tube 54 through lip 120. At the same time, however, lip 120 extends in close proximity about inner tube 54 such that lip 120 engages axial face 74 of sleeve stop 56 to prevent further extension of inner pole 32 past lip 120.

As shown by FIGS. 3 and 5, chuck 90 receives collet 88, outer pole 30 and inner tube 32. In particular, chuck 90 receives collet 88 so as to overlap detent engaging members 94. Because chuck 90 overlaps detent engaging members 94, chuck 90 further ensures that detent engaging members 94 do not become accidentally withdrawn from detents 48 of outer pole 30. This further increases the reliability of the connection between locking mechanism 34 and outer pole 30.

As best shown by FIG. 3, chuck 90 defines an interior 104 which defines interior threads 122 and tapered surface 124. Interior threads 122 threadably engage exterior threads 98 of collet 88 to couple chuck 90 to collet 88. Rotation of chuck 90 relative to collet 88 moves chuck 90 relative to collet 88 along axis 18. As a result, rotation of chuck 90 either moves tapered surface 124 towards or away from end 36 of outer pole depending upon the direction in which chuck 90 is rotated. As best shown by FIG. 6, rotation of chuck 90 so as to move chuck 90 towards end 36 of outer pole 30 forces clamping flanges 96 of collet 88 through a narrowing opening defined by tapered surface 124 at end 108. As a result, clamping flanges 96 are compressed towards axis 18 into frictional engagement with inner tube 54 of inner pole 32 to frictionally clamp inner pole 32 in place. As further shown by FIG. 6, each flange 96 includes a clamping surface 128 which preferably mirrors the exterior surface of inner tube 54 of inner pole 32 to maximize the clamping effectiveness of flanges 96. In the preferred embodiment, surface 128 of each flange 96 simultaneously engages two adjacent facets 26 to further assist in maintaining radial alignment of inner pole 32 with outer pole 30.

Figure 7:
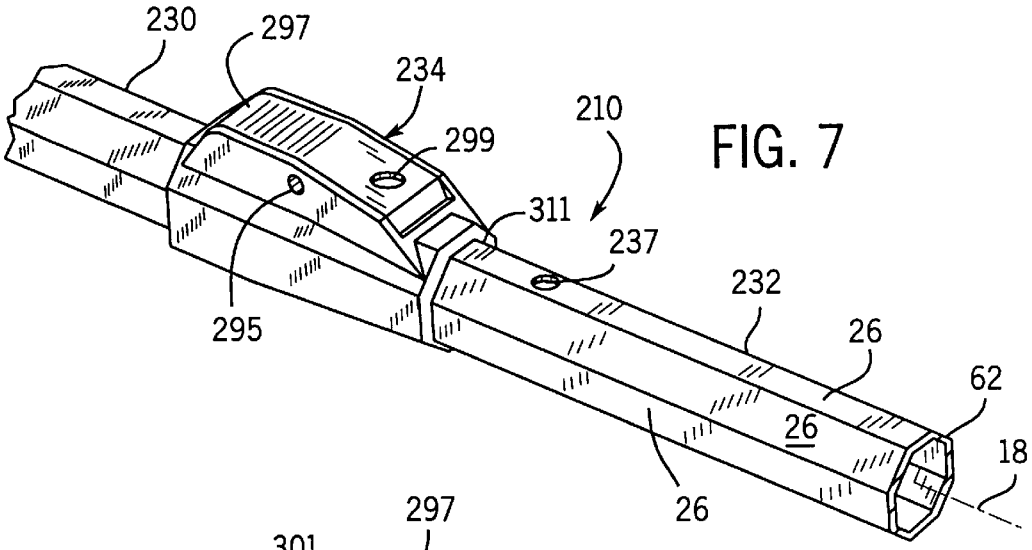
FIG. 7 is a fragmentary perspective view of an alternate embodiment of the pole of FIG. 1.
Figure 8:
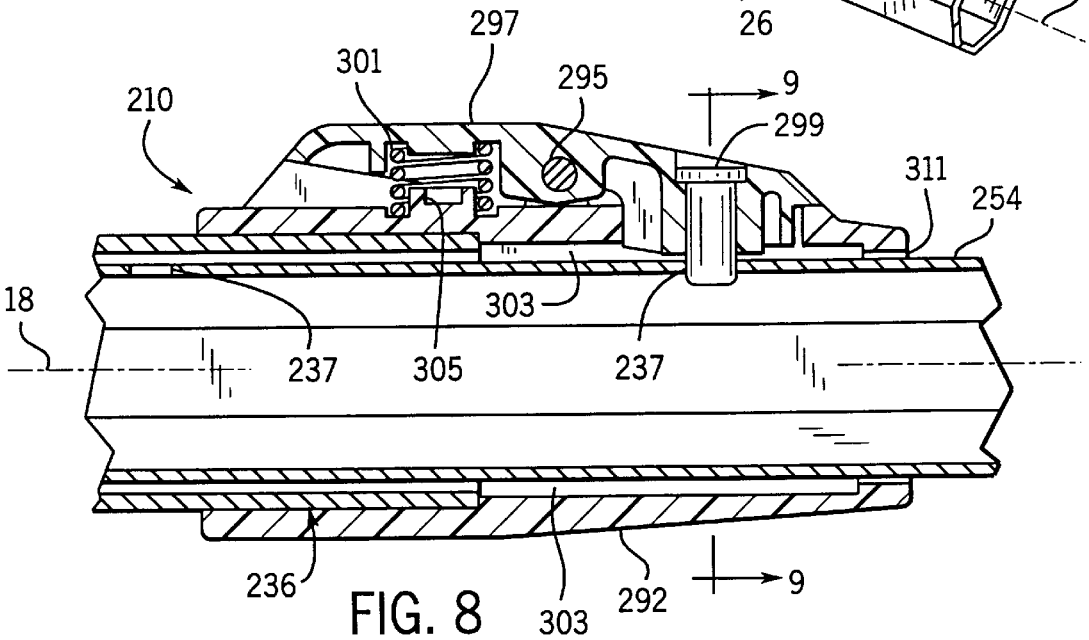
FIG. 8 is a sectional view of the pole of FIG. 7.
Figure 9:
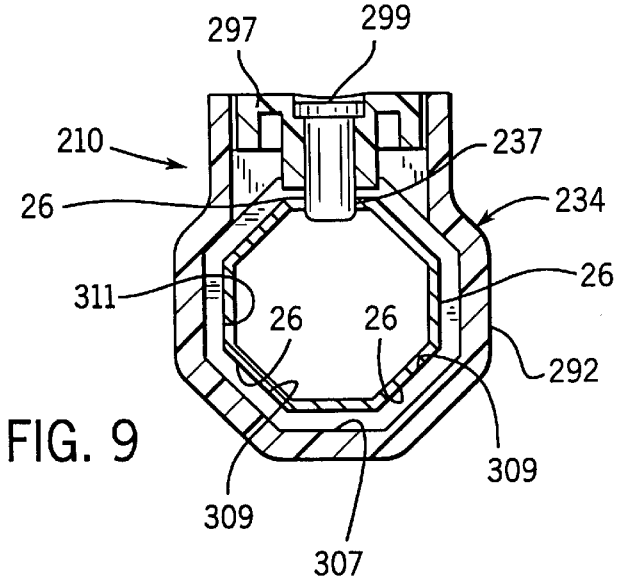
FIG. 9 is a cross-sectional view of the pole of FIG. 8 taken along lines 9—9 of FIG. 1.

FIGS. 7–9 illustrate an alternate embodiment of pole 10 illustrated in FIGS. 1–6. Pole 210 is identical to pole 10 except that pole 210 includes outer pole 230, inner pole 232 and locking mechanism 234, in lieu of outer pole 30, inner pole 32 and locking mechanism 34, respectively. As shown by FIG. 7, outer pole 230 and inner pole 232 are substantially identical to outer pole 30 and inner pole 32 except that outer pole 230 is adhesively bonded to locking mechanism 234. Inner pole 232 additionally defines a plurality of detents 237 axially spaced along its length. Detents 237 are generally holes or indentations extending through inner pole 232 towards axis 18. Although detents 237 are illustrated as holes extending completely through wall 62, detents 237 may alternatively extend only partially through walls 62. Moreover, detents 237 may comprise other deformations, shapes or depressions in the outer surface of inner pole 232. Detents 237 are positioned and generally centered along a single facet 26 for being engaged by locking mechanism 234. Detents 237 are preferably spaced along a single facet 226 to enable pole 210 to be set at a multitude of different lengths by varying the length of inner pole 232 projecting from outer pole 230. Although FIGS. 7 and 8 illustrate three detents 237, inner pole 232 preferably includes greater than three detents for providing pole 210 with a multiple of different lengths.

FIG. 8 is a cross-sectional view of pole 210 illustrating locking mechanism 234 in greater detail. As best shown by FIG. 8, locking mechanism 234 generally includes housing 292, pivot pin 295, button 297, stop pin 299 and spring 301. Housing 292 is a generally hollow tubular sleeve configured for receiving end 236 of outer pole 230. In the preferred embodiment illustrated, housing 292 is adhesively bonded to outer pole 230. Alternatively, housing 292 may be fixedly coupled to outer pole 230 with detents and detent engaging members similar to those shown in pole 10. Housing 292 additionally includes ribs 303 and spring retainer 305. Ribs 303 are preferably integrally formed with housing 292 and project inwardly towards axis 18 sufficiently proximate to inner tube 254 so as to engage axial face 112 of sleeve stop 56 (shown in FIG. 3) to limit the degree to which inner pole 232 may be withdrawn from outer pole 230. Ribs 303 additionally serve to guide movement of inner pole 232 through housing 292 of locking mechanism 234 to prevent rotation and to prevent inner pole 232 from binding within outer pole 230.

Spring retainer 305 generally comprises an outwardly projecting protuberance configured for receiving and retaining spring 301 in engagement with button 297 for pivoting button 297 about pivot pin 295.

Pivot pin 295 is coupled to and supported by housing 292 in engagement with button 297. Pivot pin 295 pivotally supports button 297 for pivoting stop pin 299 into and out of engagement with detents 237 and inner pole 232. Button 297 is pivotally coupled to housing 292 by pivot pin 295 and carries stop pin 299. Stop pin 299 is a downwardly extending protuberance projecting from button 297 for engagement with a selected one of detents 237 in inner pole 232. In the preferred embodiment illustrated, stop pin 299 is a metal pin which is fixedly mounted to an end of button 297. As can be appreciated, stop pin 299 may have a variety of different configurations and may alternatively be integrally formed as part of button 297. Stop pin 299 is preferably resiliently biased towards inner pole 232 so as to automatically project into detent 237 when aligned over detent 237.

Spring 301 is a conventionally known compression spring captured between spring retainer 305 of housing 292 and button 297 to pivot button 297 about pivot pin 295. Spring 301 resiliently biases stop pin 299 towards inner tube 232. As a result, spring 301 automatically forces stop pin 299 into one of detents 237 when stop pin 299 is aligned with detent 237. At the same time, manual depression of button 297 compresses spring 301 and pivots button 297 about pivot pin 295 to withdraw stop pin 299 from a particular engaged detent 237 so that inner pole 232 may be further withdrawn from outer pole 230 or further inserted into outer pole 230 as desired. Although locking mechanism 234 is illustrated as including pivot pin 295, button 297, stop pin 299 and spring 301 for engaging detents 237 along pole 210, locking mechanism 234 may alternatively include any one of a variety of well known aiternative pin actuation mechanisms for engaging detents 237 to secure outer pole 230 relative to inner pole 232.

FIG. 9 is a cross-sectional view of pole 210 taken along lines 9—9 of FIG. 8. As best shown by FIG. 9, housing 292 of locking mechanism 234 defines a plurality of inwardly facing facets 307 and 309 which mirror and face corresponding outwardly facing facets 26 of inner pole 232. Inwardly facing facets 307 extend substantially along the entire length of housing 292 while inwardly facing facets 309 extend about mouth 311 of housing 292. Inwardly facing facets 309 face corresponding outwardly facing facets 26 of inner pole 232 to limit or prevent unintended rotation of inner pole 232 relative to outer pole 230 and locking mechanism 234. Because inwardly facing facets 309 assist in preventing unintended rotation of inner pole 232 relative to locking mechanism 234, inwardly facing facets 309 provide more accurate alignment of detents 237 with stop pin 299 to provide more reliable locking action. Inwardly facing facets 309 further assist in centering and guiding movement of inner pole 232 to prevent undesirable binding. In addition, because inwardly facing facets 309 limit and prevent rotation of housing 292 relative to inner pole 232, facets 309 also assist in maintaining housing 292 fixedly coupled to outer pole 230.

Overall, poles 10 and 210 provide elongate tool supporting poles that are easier to grip as well as easier to maneuver than conventional round, fluted and ribbed poles due to the plurality of outwardly facing facets 26. In particular, facets 26 prevent rotation or slippage of a user's hand relative to poles 10 and 210 and less squeezing of the user's hands than typically required for conventional round, fluted and ribbed poles. This feature is especially critical when poles 10 and 210 become wet with paint or perspiration. As a result, poles 10 and 210 are less likely to twist in the user's hands, are more ergonomic and are less fatiguing.

Because poles 10 and 210 preferably define outwardly facing facets 26 along their entire length, poles 10 and 210 may be easily gripped anywhere along their length when needed. Because poles 10 and 210 are preferably extendable and include an inner pole, an outer pole and a locking mechanism, poles 10 and 210 may be easily adjusted in length as needed. Because the outer pole defines a plurality of inwardly facing facets at its mouth corresponding to the plurality of outwardly facing facets, poles 10 and 210 are less subject to binding and rotation relative to one another. As a result, the locking mechanism is more reliably attached to the outer pole. In addition, rotational alignment of the inner pole relative to the outer pole is maintained to simplify locking of the inner pole relative to the outer pole. Thus, tool supporting poles 10 and 210 are simpler to manufacture, more durable, more ergonomic and less fatiguing to use.

Although the present invention has been described with reference to preferred embodiments, workers skilled in the art will recognize that changes may be made in form and detail without departing from the spirit and scope of the invention.

What is claimed is:

1. A pole for supporting a tool, the pole comprising:

an elongate body extending along an axis and including:

a first tube defining eight outwardly facing facets about the axis and extending substantially along an entire length of the first tube;

a second tube telescopically received within the first tube for adjusting a length of the pole, wherein the second tube defines at least one outwardly facing facet extending substantially along a length of the second tube; and a locking mechanism for selectively locking the second tube relative to the first tube along the axis, wherein the locking mechanism includes:

a plurality of axially spaced detents defined in said at least one outwardly facing facet of the second tube; and a detent engaging member fixedly coupled to the first tube, wherein the detent engaging member moves between a first engaged position in which the member engages the detent to lock the first and second tubes relative to one another and a disengaged position in which the member is disengaged from the detent to permit the first and second tubes to telescopically move relative to one another.

2. The pole of claim 1 wherein the elongate body includes a tool supporting portion at a first end and a handle portion at a second end, wherein the eight outwardly facing facets are defined at least along the handle portion.

3. The pole of claim 1 wherein the second tube defines eight outwardly facing facets.

4. The pole of claim 3 wherein the first tube defines eight inwardly facing facets about the axis corresponding to the eight outwardly facing facets defined by the second tube.

5. The pole of claim 1 wherein the first tube defines at least one inwardly facing facet about the axis opposite the at least one outwardly facing facet of the second tube.

6. The pole of claim 1 wherein the locking mechanism includes a body fixedly coupled to the first tube by a connector including:

a detent defined by the first tube; and a detent engaging member projecting from the body and received within the detent to fixedly couple the body of the locking mechanism to the first tube.

7. The pole of claim 6 wherein the locking mechanism comprises:

a collet having a plurality of flanges extending from the body into engagement with the second tube; and a chuck having a tapered interior for receiving the plurality of flanges, wherein movement of the chuck along the axis clamps the flanges against the second tube.

8. The pole of claim 7 wherein the chuck threadably engages the body to move along the axis.

9. The pole of claim 7 wherein the chuck defines a plurality of outwardly facing facets about the axis.

10. The pole of claim 7 wherein the chuck overlaps the detent engaging member to maintain the detent engaging member within the detent.

11. An extendable pole for supporting a tool, the pole comprising:

a first tube having a length and eight outwardly facing facets extending substantially along an entire length of the first tube;

a second tube telescopically received within the first tube, the second tube having eight outwardly facing facts;

a detent defined in one of the first tube and the second tube; and a locking mechanism fixedly coupled to said one of the first and second tubes for releasably locking the first tube relative to the second tube, the locking mechanism including:

a body having a detent engaging protuberance projecting from the body into engagement with the detent to fixedly couple the locking mechanism to said one of the first and second tubes.

12. An extendable pole for supporting a tool, the pole comprising:

a first tube having a length and eight outwardly facing facets extending substantially along an entire length of the first tube;

a second tube telescopically received within the first tube;

a collet fixedly coupled to a first one of the first and second tubes in frictional engagement with a second one of the first and second tubes; and a chuck having a tapered interior for receiving at least a portion of the collet, wherein the chuck threadably engages the collet to clamp the collet against the second one of the first and second tubes and wherein the chuck defines eight outwardly facing facets.

13. A pole for supporting a tool, the pole comprising:

an elongate body extending along an axis and including:

a first tube defining eight outwardly facing facets about the axis and extending substantially along an entire length of the first tube; and a second tube telescopically received within the first tube for adjusting a length of the pole; and a locking mechanism for selectively locking the second tube relative to the first tube along the axis, wherein the locking mechanism includes a body fixedly coupled to the first tube by a connector including:

a detent defined by the first tube; and a detent engaging member projecting from the body and received within the detent to fixedly couple the body of the locking mechanism to the first tube.

* * * * *